United States Patent [19]

Vestering

[11] Patent Number: 4,964,536

[45] Date of Patent: Oct. 23, 1990

[54] CARTON HOLDING AND POURING DEVICE

[76] Inventor: Gerardus B. A. Vestering, 1720 Gore Road, London, Ontario, Canada

[21] Appl. No.: 260,093

[22] Filed: Oct. 20, 1988

[51] Int. Cl.[5] ..... B65D 23/10

[52] U.S. Cl. ..... 222/83; 220/85 H; 222/89; 222/475; 294/31.2

[58] Field of Search ..... 294/27.1, 31.2, 33; 222/81, 83, 83.5, 85, 86, 89, 90, 465.1, 472, 473, 475, 566, 567; 220/85 H, 85 SP, 94 R, 96

[56] References Cited

U.S. PATENT DOCUMENTS

| | | | |
|---|---|---|---|
| 654,795 | 7/1900 | Kidder | 222/83 |
| 2,747,771 | 5/1956 | Mercer | 222/81 |
| 3,024,943 | 3/1962 | Yeager | 220/85 H |
| 3,285,472 | 11/1966 | Olson | 222/86 |
| 4,723,689 | 2/1988 | Vallos et al. | 222/91 |

FOREIGN PATENT DOCUMENTS

| | | | |
|---|---|---|---|
| 113053 | 2/1969 | Denmark | 222/81 |

*Primary Examiner*—Johnny D. Cherry

*Attorney, Agent, or Firm*—Armstrong, Nikaido, Marmelstein, Kubovcik & Murray

[57] ABSTRACT

A carton holding and pouring device for a carton having a pair of side panels and a pair of end panels with an upper part of each end panel folded under an upper part of both side panels to provide recess at each end of a sealed top of the carton which includes a rectangular frame having a pair of side walls and a pair of end walls dimensioned to slidably receive the side panels and end panels of the carton with each of the end walls of the frame including a clamp plate biased toward the other end wall and adapted for engagement with one of the end panels of the carton in the recesses at each end of the sealed top of the carton. A pouring spout is provided on one of the side walls of the frame and is adapted to puncture an upper part of one of the side panels of the carton. The clamp plates on each of the end walls of the rectangular frame are expanded to permit the frame to slide over the sealed top of the container and then released to engage and secure the frame to the end panels in the recesses at the top of the carton thereby permitting the spout to puncture an upper part of a side panel of the carton punctured by the spout with the rectangular frame secured to the carton.

7 Claims, 3 Drawing Sheets

CARTON HOLDING AND POURING DEVICE

BACKGROUND OF THE INVENTION

The present invention is directed to a carton holding and pouring device and, more specifically, to a carton of the type used for packaging, storing and marketing liquids such as milk and juice as well as other particulate materials.

Such cartons of the type to which the present invention is directed are usually formed from a blank paper stock which is folded into the general form of a parallelepiped having four sides, a bottom, and a top wherein the upper part of two of the sides are folded over upon the upper parts of the other two sides to provide a sealed top having a tab or ridge extending along the upper most portion thereof and a pair of recesses at each end of the sealed tab. The blank materials for such cartons are usually formed of a paper stock which is coated with a wax or plastic coating to render the material impermeable to liquid and gaseous penetration thereby providing a material capable of sealing the carton contents against leakage and penetration by external gases or liquids which could prematurely age or otherwise adversely effect the contents of the carton.

Cartons of this type are frequently used for packaging, storing and marketing milk and juice at consumer outlets and can be used equally well for other liquids and/or products in granular form such as soap powders or other materials which are in a form that can be easily poured from the carton once the carton has been opened. These cartons usually bear printed instructions that they should be opened by spreading the recessed portion at one end of the sealed tab at the upper part of the carton in order to break the seal and permit that upper portion of the carton to be unfolded in the form of a spout to facilitate easy pouring of the contents.

Although the instructions and steps required to open such cartons are relatively simple, difficulties may be encountered when attempting to break the seal at the top of the carton. Occasionally the seals have been made so tight that they are difficult to open since the instructions generally require the seal to be broken or split halfway across the tab in order to provide access to the upper part of one of the end panels in order that it may be withdrawn to shape the spout recommended for pouring.

Another problem encountered with cartons of this type is that the larger cartons, for example those cartons which are of the 2 liter or ½ gallon size and larger, are somewhat difficult to handle since they can accommodate a substantial weight in terms of the contents of the carton and the lateral walls of the carton being relatively thin and resilient do not provide a good gripping surface or handle for holding the carton. This is particularly difficult with such cartons that have been previously opened since they are not transparent and therefore one cannot anticipate the weight of the remaining contents and difficulty that may be encountered in attempting to grasp, lift and pour such contents from a previously opened carton.

There have been several prior attempts to alleviate such problems. U.S. Pat. No. 3,615,115 issued on Oct. 26, 1971 and U.S. Pat. No. 3,692,346 issued on Sept. 19, 1972 both disclose a detachable handle for such cartons. The detachable carton handles disclosed by these patents may be effective in providing ease of handling once the carton is open, but neither patent discloses anything relative to opening the carton other than breaking the seal and unfolding the upper part of one of the end panels as described above. U.S. Pat. No. 4,723,689, issued Feb. 9, 1988, discloses a holder for such cartons which is provided with a spigot and a spout which can be threaded into the spigot to puncture the carton and provide a pouring spout.

The present invention provides an improved carton holding and pouring device for a carton of the type described above which can be easily fit to provide a very stable engagement with such a carton and provides an arrangement for easily and firmly grasping the carton as well as a novel and vastly improved apparatus and arrangement for opening the carton to facilitate pouring of the content provided therein.

SUMMARY OF THE INVENTION

The present invention provides a carton holding and pouring device for a carton having a pair of side panels and a pair of end panels with an upper part of each end panel folded under an upper part of both side panels to provide a recess at each end of a sealed top of the carton which includes a rectangular frame having a pair of side walls and a pair of end walls dimensioned to slidably receive the side panels and end panels of the carton with each of the end walls of the frame including an element biased toward the other end wall and adapted for engagement with one of the end panels of the carton in the recesses at each end of the sealed top of the carton. A pouring spout is provided on one of the side walls of the frame and is adapted to puncture an upper part of one of the side panels of the carton and means are provided for manually grasping the rectangular frame. The elements on each of the end walls of the rectangular frame are expanded to permit the frame to slide over the sealed top of the container and then released to engage and secure the frame to the end panels in the recesses at the top of the carton thereby permitting the upper part of a side panel of the carton to be punctured by the spout with the rectangular frame secured to the carton.

In the preferred embodiment, a handle is provided to project from the side wall of the frame opposite the pouring spout and the elements adapted for engagement with the carton end panels in the recesses comprise a pair of clamp plates with each clamp plate formed with one of the side walls and projecting upwardly and inwardly for surface contact with an inclined triangular surface of the upper part of each end panel.

In the preferred embodiment the clamp plates are each formed as a planar member having a pair of converging lateral edges which abut a pair of converging fold lines at each of two edges of a triangular surface of the upper part of the end panel in each recess. The lateral edges of each clamp plate preferably converge at an angle of about 90° and each clamp plate preferably has a surface contacting at least ⅓ of the area of the triangular surface in each recess.

In the preferred embodiment each clamp plate is provided on an arm extending upwardly from a side wall of the rectangular frame and the arms preferably incline toward each other at an angle to enhance the biasing force seating the clamp plates in the recesses.

In the preferred embodiment, a tab projecting upwardly from each arm or some other arrangement is provided to facilitate gripping the arms to manually withdraw the arms against the biasing force.

In the preferred embodiment the pouring spout is provided in the form of a lever pivotally mounted to one side wall of the frame. A fluid flow passage is provided on one side of the lever and a pointed projection is provided at one end and on the other side of the lever whereby the lever may be raised by the other end to cause the pointed projection to puncture and penetrate the upper part of one side panel of the carton and dispose one end of the lever internally of the carton with the fluid flow passage extending from inside the carton to the outside.

The pointed projection on the pouring spout is preferably provided in the form of a beak or pyramid projecting from the other side of the lever. In the preferred embodiment, the pointed projection is provided in the form of a pyramid having four triangular faces joined at four edges and converging at a common vortex with three of the triangular faces undercut adjacent the edges to provide a plurality of sharp edges.

The pouring spout fluid flow passage is preferably provided between a pair of spaced walls with each spaced wall having a radiused portion opposed to and blending with an outer surface of the pointed beak shaped projection and being concentric with the pivotable mounting of the lever. With this structural arrangement the pointed beak shaped projection punctures and penetrates the upper part of one side panel of the carton with two diverging cutting edges of the projection cutting a triangular tab in the side panel and the beak and radius portion of each side wall spreading the portions of the side panel adjacent the tab until one end of the lever is disposed internally of the carton with the U-shaped flow passage projecting externally of the carton. Each radiused portion of the spaced walls providing the fluid flow passage is preferably provided with a notch adapted to engage an edge of the upper part of the side panel of the carton to lock the lever in position. A radiused surface is also provided to extend between the ends of the diverging cutting edges at the base of the beak shaped projection to fold a base portion of the triangular tab inwardly and effect a leak resistance seal between the lever and the side panel of the carton.

The present invention and the advantages provided thereby will be more fully understood with reference to the following Detailed Description of the Preferred Embodiment taken in conjunction with the accompanying drawings.

DESCRIPTION OF THE PREFERRED EMBODIMENT

Figure 1:
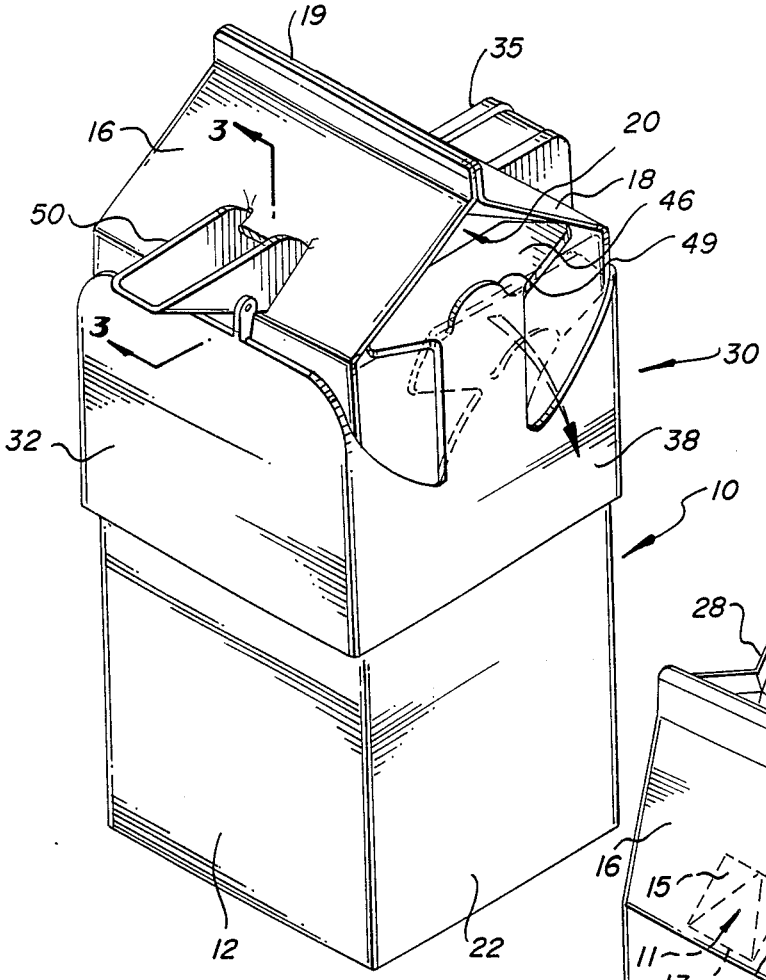
FIG. 1 is a perspective view of a carton with the holding and pouring device of the present invention assembled thereto.

With reference to the drawings wherein like reference numerals designate the same or like parts throughout, there is shown in FIG. 1 a carton 10 having a holding and pouring device 30 secured thereto.

Figure 2:
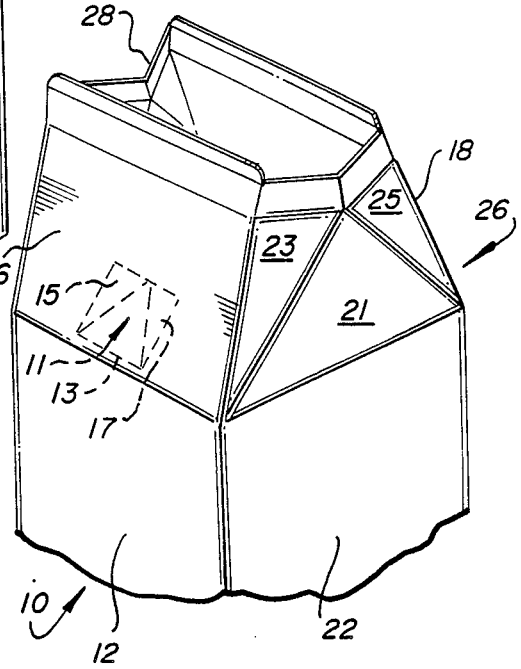
FIG. 2 is a perspective view of the upper part of a carton in an intermediate stage of manufacture to illustrate the manner in which the upper parts of the carton are folded and sealed.

The carton 10 is of general parallelepiped form having a rectangular bottom, a pair of side panels and a pair of end panels with only one side panel 12 and one end panel 22 being shown in FIG. 1. The top of the carton 10 is formed in such a manner that the upper part 26 and 28 of each end panel is folded under an upper part 16 and 18 of the side panels so as to provide a recess 20 at each end of a sealed top 19 of the carton. With reference to FIG. 2, as each carton is being formed and sealed, the upper parts 26 and 28 of the end panels such as end panel 22 are folded inwardly along a pair of converging fold lines so as to provide an inclined equilateral triangular surface 21 internally of each recess 20. The triangular surfaces 21 are essentially covered internally of the recess 20 by the triangular surfaces 23 and 25 which are folded on the other side of the fold lines to oppose the triangular surface 21.

The holding and pouring device 30 is provided in the form of a rectangular frame 31 comprising a pair of oppositely disposed side walls 32 and 34 and a pair of oppositely disposed end walls 36 and 38. A pair of upstanding projections 51 having axially aligned apertures 53 are provided to the side wall 32. A handle 35 is formed integrally with the other side wall 34.

Figure 6:
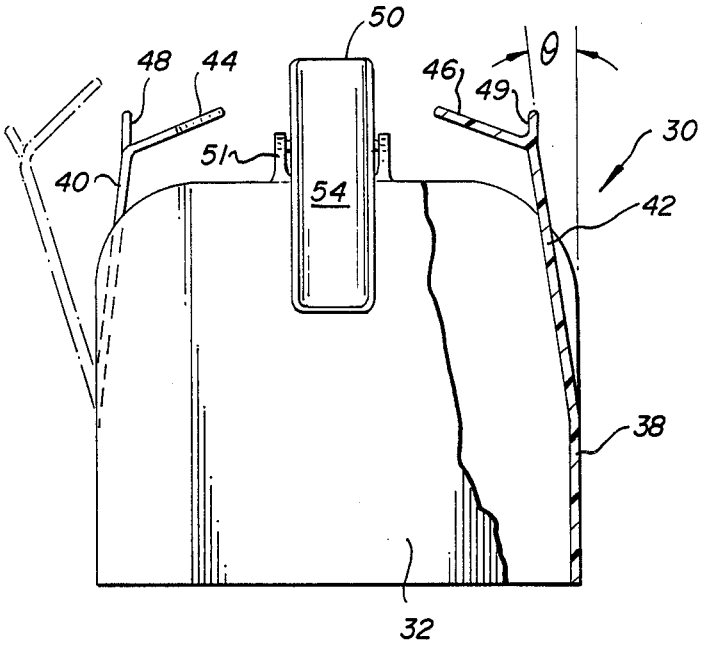
FIG. 6 is a front elevation of the rectangular frame of the device of the present invention with the pouring spout mounted thereto.
Figure 7:
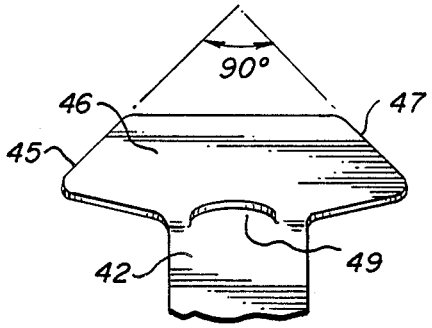
FIG. 7 is a plan view of one of the clamping plates and supporting arms of the deice of the present invention.

The end walls 36 and 38 of the rectangular frame 31 are each respectively provided with an upwardly extending arm 40 and 42 which in turn respectively mount upwardly and inwardly projecting clamp plates 44 and 46. The clamp plates 44 and 46 are each preferably provided as a planar member having a pair of converging lateral edges 45 and 47. The lateral edges 45 and 47 of each of the clamp plates preferably converge at an angle of about 90° as shown by FIG. 7. The upwardly extending arms 40 and 42 are each respectively formed with an upwardly projecting tab 48 and 49 and are also formed to normally incline toward each other. As best shown by FIG. 6 the upwardly extending arm 42 is formed to taper inward from the end wall 38 toward the arm 40 at an angle $\theta$. In the preferred embodiment the angle $\theta$ is 7°, although other angles may serve equally well.

The upwardly projecting tabs 48 and 49 are provided to permit a user to grasp the tabs 48 and 49 with a fingertip thereby permitting the arms 40 and 42 and the clamp plates 44 and 46 to be easily displaced outwardly as shown by the dot dash representation of the arm 40 and clamp plate 44 in FIG. 6.

Figure 8:
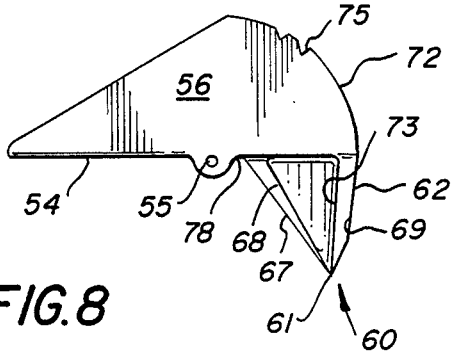
FIG. 8 is a side elevation of a pouring spout.
Figure 10:
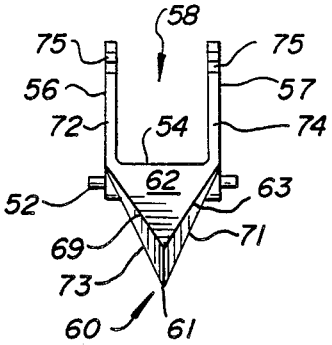
FIG. 10 is a front elevation of the pouring spout of FIG. 8.
Figure 9:
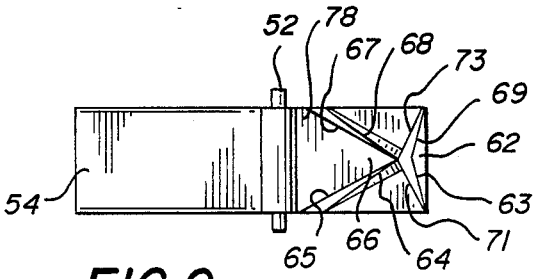
FIG. 9 is a bottom view of the pouring spout of FIG. 8.

The combination puncturing device and pouring spout 50 as shown by FIGS. 8–10 of the drawings is provided in the form of a lever with a base portion 54 comprising a lever pivotally mounted to the apertures 53 provided in the upstanding projections 51 on the side wall 32 of the rectangular frame 31. The pouring spout 50 may be formed with an aperture 55 as shown by FIG. 8 for receiving a pivot pin or integrally formed with trunnions 52 as shown by FIG. 9 and 10. A pair of upstanding walls or flanges 56 and 57 are provided at each side of the base portion 52 to provide a generally U-shaped flow passage 58. A beak-like pointed projection 60 is provided at one end of the base portion 54 on the side of the base portion opposite from the flow passage 58. The beak-like pointed projection 60 is preferably provided in the form of a pyramid having four triangular faces 62, 64, 66 and 68 joined at four edges 71, 65, 67 and 73 and converging at a common vertex or point 61. In the preferred embodiment the triangular faces 64 and 68 are severely cut away to provide a pair of sharp edges 71 and 73. The triangular face 66 is completely undercut to provide a cutting sharpness on the edges 65 and 67 for a purpose to be more fully described below.

The walls 56 and 57 forming the flow passage 58 of the pouring spout 50 are respectively radiused at 72 and 74. The radiused portions 72 and 74 of the walls 56 and 57 are concentric with the axis about which the pouring spout 50 pivots and are struck so as to blend into the surface defined by the triangular face 62 of the beak-like projection. At least one notch 75 is provided at a predetermined location in the radiused portions 72 and 74 of the walls 56 and 58.

The base portion 54 of the pouring spout 50 is also provided with a radiused surface portion 78 which extends adjacent to the pivot axis laterally across the base portion 54 between the ends of the diverging cutting edges 65 and 67 at the base of the pyramid or beak shaped projection.

The manner in which the carton holding and pouring device is used will now be described.

The dimensions of the side walls 32 and 34 and end walls 36 and 38 of the rectangular frame are such as to permit the frame to be slidably received externally of a carton, for example, a carton of the ½ gallon or 2 liter size. In order to properly seat the holding and pouring device 30 on a carton as shown in FIG. 1 of the drawings, it is necessary to manually engage the tabs 48 and 49 provided to the upwardly extending arms 40 and 42 in order that the clamp plates be withdrawn to pass the top of the carton and then released to engage the inclined triangular surfaces 21 of the upper parts of the end panels in the recesses 20. The converging lateral edges 45 and 47 of the clamping plates are designed to seat snugly against the fold lines provided between the inclined triangular surfaces 21 and the oppositely disposed triangular surfaces 23 and 25 with the clamp plates 44 and 46 contacting at least one-third of the area of the triangular surfaces 21. With the holding and pouring device 31 assembled as shown in FIG. 1, the end panels of the carton force both of the upwardly extending arms 40 and 42 outwardly against the normal inclination indicated by the angle $\theta$ in FIG. 6. The tendency of the arms 40 and 42 to return to their normal position serves as a biasing force urging the clamp plates 44 and 46 into firm contact with the triangular surfaces 21 thereby providing a secure and stable assembly of the holding and pouring device 30 to the carton 10.

Figure 3:
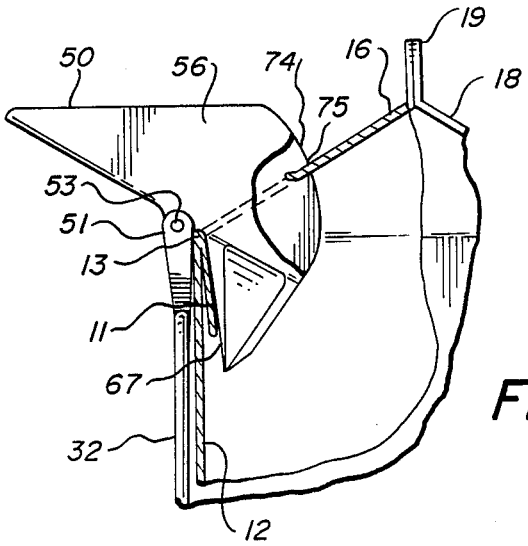
FIG. 3 is a sectional view taken along the line 3—3 of FIG. 1.
Figure 4:
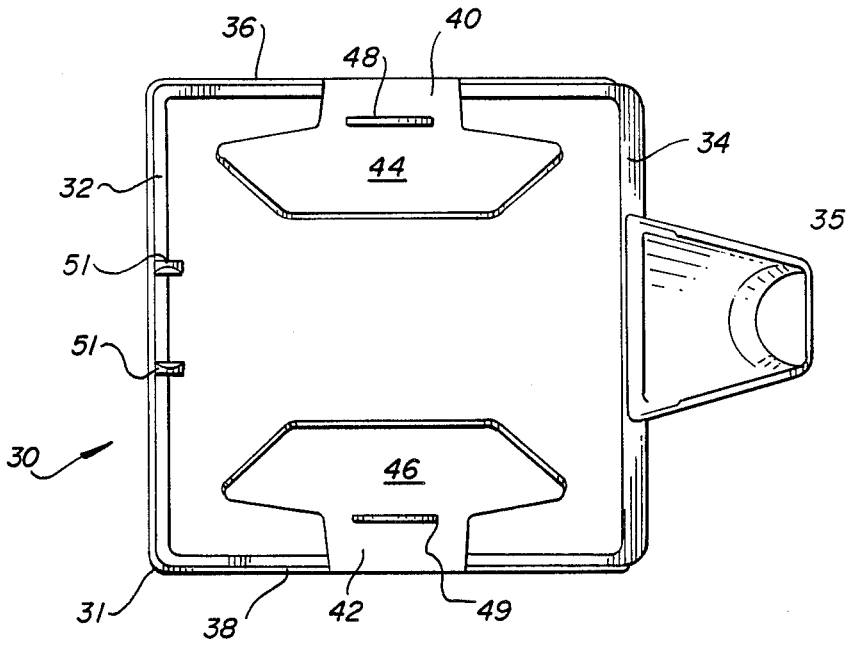
FIG. 4 is a plan view of the rectangular frame of the device of the present invention.
Figure 5:
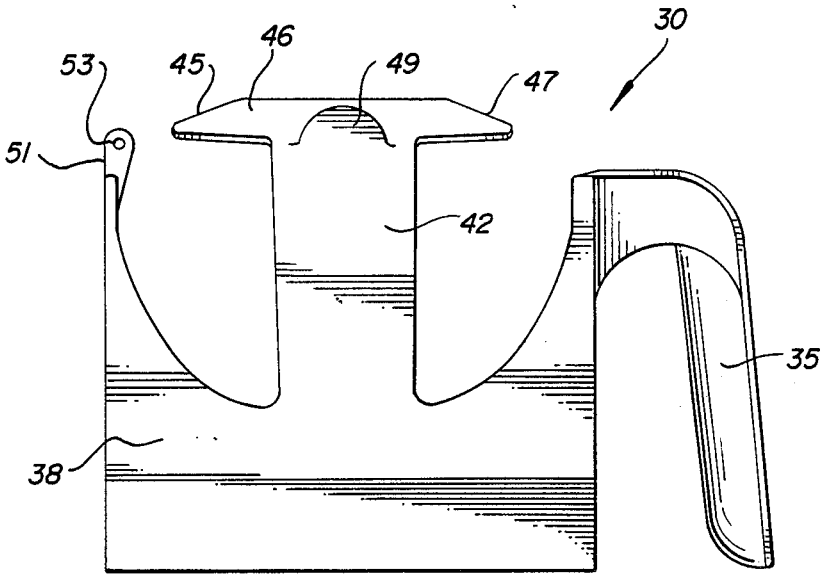
FIG. 5 is a side elevation of the rectangular frame of the device of the present invention.

During assembly, the pouring spout 50 being free to pivot about its axis will normally rest in a position as shown by FIG. 6 with the beak-like pointed projection resting externally on an upper part of one of the side panels such as, for example, the upper part 16 of the side panel 12 of the carton 10. Once the clamp members 44 and 46 are firmly seated in the recesses 20 the lower end of the pouring spout 50 as shown in FIG. 6 is grasped and pivoted upwardly to cause the beak-like pointed projection 60 to penetrate and puncture the upper part 16 of the side panel 12 of the carton. This upward pivoting movement of the pouring spout 50 is continued until the pouring spout 50 reaches the position as shown by FIGS. 1 and 3. During this movement the point 61 of the beak-like projection 60 penetrates the upper part 16 of the side panel 12 and the divergent sharp cutting edges 65 and 67 respectively cut along divergent lines cutting a tab generally in the form of an equilateral triangle 11 as represented by two dot dash lines in FIG. 2. As the generally triangular tab 11 is being cut, the beak-like pointed projection and the radiused portions 72 and 74 of the flow passage walls 56 and 57 cut the upper edges of the adjacent triangular portions 15 and 17 and fold the same internally of the carton adjacent the side walls 56 and 57 of the flow passage 58. This pivoting movement of the pouring spout 50 to penetrate and provide an opening through the upper part 16 of the side panel 12 is continued until the notches 75 provided in the radiused portions 72 and 74 engage an edge of the thus opened upper part 16 of the side panel 12.

As shown by FIG. 3, engagement of the notches 75 with the upper part 16 of the side panel 12 locks the pouring spout 50 in position with the radiused portion of the U-shaped flow passage 58 internally of the carton and the flow passage projecting externally to permit pouring or removal of the contents within the carton. In this position the triangular tab 11 is folded internally of the carton 10 with the double fold line 13 seated tightly against the radiused portion 78 extending laterally across the base portion 54 between the diverging cutting edges 65 and 67 at the base of the beak shaped projection 60. The notches 75 engaging the upper part 16 of the side panel 12 hold the pouring spout 50 in position with the radiused portion 78 tightly seated against the double fold portion 13 at the base of the triangular tab Il to provide an effective seal against fluid leakage across the base portion 54 of the pouring spout 50. The tabs 15 and 17 which have been folded back against the outer surfaces of the side walls 56 and 57 provide an effective fluid seal against leakage along the sides of the pouring spout 50.

When the container is empty, the pouring spout 50 is pivoted out of the opening cut through the upper part 16 of the side panel 12, the clamp plates 44 and 46 are withdrawn manually and the holding and pouring device 30 is lifted off the empty container ready for use in the same manner on another container.

Although a handle such as the handle 35 described above may be formed integrally with one of the side walls of the rectangular frame 31, the rectangular frame 31 may be used without a separate handle since the clamp plates 44 and 46 provide such a stable and secure attachment to the carton that one can quite comfortably grasp the frame using the end walls 36 and 38 and the side wall 34 without the provision of a separate handle per se.

It should also be noted that although it is preferred to undercut three of the triangular faces of the pyramid shaped beak-like projection 60 that the diverging cutting edges 65 and 67 perform the primary function of cutting the diverging sides of the triangular tab 11 and the diverging cutting edges 65 and 67 would be provided if only one triangular face, namely triangular face 66 were undercut adjacent the edges 65 and 67.

Although a single embodiment of the invention has been disclosed, the present invention is not to be construed as limited to the particular form disclosed herein since the foregoing description is to be regarded as illustrative rather than restrictive and it should be understood that modifications and variations in the details of the construction disclosed herein may be made without departing from the spirit and scope of the invention as defined by the claims appended hereto.

I claim:

1. A carton holding and pouring device for a carton having a pair of side panels and a pair of end panels with an upper part of each end panel folded under an upper part of both side panels to provide an inclined triangular surface in a recess at each end of a sealed top of the carton comprising:

a rectangular frame having a pair of side walls and a pair of end walls dimensioned to slidably receive said side panels and said end panels of said carton, each of said end walls of said frame including an upwardly extending arm and a clamp plate on each of said upwardly extending arms, each of said clamp plates projecting upwardly and inwardly for surface contact with one of said triangular surfaces at one end of the sealed top of said carton, at least one of said upwardly extending arms formed to incline toward the other upwardly extending arm at an angle to bias the clamp plate on that arm toward the other upwardly extending arm while providing sufficient flexibility to withdraw said clamp plate against said bias, a pouring spout on one of said side walls of said frame and adapted to puncture an upper part of one of said side panels, and means for manually grasping said rectangular frame, whereby said upwardly extending arms on each of said end walls may be expanded to permit said rectangular frame to slide over the sealed top of said carton and released to engage said clamp plates in said recesses and said upper part of one of said side panels may be punctured by said spout with said clamp plates contacting said triangular surfaces and securing said rectangular frame to said carton.

2. The carton holding and pouring device defined by claim 1, wherein said angle is about 7°.

3. The carton holding and pouring device defined by claim 1, further including means for gripping said arms to withdraw said arms against said bias.

4. The carton holding and pouring device defined by claim 3 wherein said means for gripping comprise a tab projecting upwardly from each said arm.

5. A carton holding and pouring device for a carton having a pair of side panels and a pair of end panels with an upper part of each end panel folded under an upper part of both side panels to provide a recess at each end of a sealed top of the carton comprising:

a rectangular frame having a pair of side walls and a pair of end walls dimensioned to slidably receive said side panels and said end panels of said carton, each of said end walls of said frame including means biases toward the other end wall and adapted for engagement with one of said end panels in one of said recesses, a pouring spout pivotally mounted to one of said side walls of said frame and adapted to puncture an upper part of one of said side panels, said pouring spout comprising a lever having a pair of spaced walls providing a U-shaped fluid flow passage on one side of said lever and a pointed beak shaped projection on the other side of said lever at one end of said lever, said beak shaped projection including two diverging cutting edges, a radiused portion of each of said spaced walls is opposed to and blends with an outer surface of said pointed beak shaped projection, said radiused portion of said spaced walls being concentric with the pivoted mounting of said lever, and means for manually grasping said rectangular frame;

whereby said means on each of said end walls and biased toward the other end wall may be expanded to permit said rectangular frame to slide over the sealed top of said carton and released to engage said end panels and secure said rectangular frame to said carton and said lever may be raised by the other end of said lever to cause said pointed beak shaped projection to puncture and penetrate said upper part of said one side panel with said diverging cutting edges cutting a triangular tab in said upper part of said one side panel and said beak shaped projection and said radiused portion of each of said side walls spreading the portions of said side panel adjacent said tab until said one end of said lever is disposed internally of said carton with said U-shaped flow passage projecting externally of said carton.

6. The carton holding and pouring device defined by claim 5, wherein each radiused portion of said spaced walls includes a notch adapted to engage an edge of said upper part of said one side panel and lock said lever in position.

7. The carton holding and pouring device defined by claim 5, wherein said lever includes a radiused surface extending between the ends of said diverging cutting edges at the base of said pointed beak shaped projection to fold a base portion of said triangular tab inwardly and effect a leak resistant seal between said lever and said side panel of said carton.

* * * * *